United States Patent [19]

Hayashi et al.

[11] Patent Number: 4,522,051

[45] Date of Patent: Jun. 11, 1985

[54] CONTINUOUS ROLLING MILL

[75] Inventors: Masahiro Hayashi, Hitachi; Makoto Shimizu; Kazuo Kobayashi, both of Ibaraki; Teruo Sekiya, Takahagi, all of Japan

[73] Assignee: Hitachi, Ltd., Tokyo, Japan

[21] Appl. No.: 494,705

[22] Filed: May 16, 1983

[30] Foreign Application Priority Data

May 17, 1982 [JP] Japan ..... 57-81384

[51] Int. Cl.[3] ..... B21B 13/08; B21B 31/08

[52] U.S. Cl. ..... 72/235; 72/239

[58] Field of Search ..... 72/235, 238, 239

[56] References Cited

U.S. PATENT DOCUMENTS

| | | | |
|---|---|---|---|
| 3,418,838 | 12/1968 | Rotert et al. | 72/239 |
| 3,646,795 | 3/1972 | Hinterholzl | 72/238 |
| 3,782,161 | 1/1974 | McGeeney et al. | 72/239 |
| 4,005,594 | 2/1977 | Reth et al. | 72/239 |
| 4,366,694 | 1/1983 | Pariseau et al. | 72/235 |

FOREIGN PATENT DOCUMENTS

| | | | |
|---|---|---|---|
| 92210 | 7/1980 | Japan | 72/239 |

*Primary Examiner*—Francis S. Husar
*Assistant Examiner*—Steven B. Katz
*Attorney, Agent, or Firm*—Beall Law Offices

[57] ABSTRACT

A continuous rolling mill has horizontal roll stands and vertical roll stands disposed alternatingly with rolling guides between the work rolls of adjacent roll stands. The roll stands together with the rolling guides are movable in the direction crossing the rolling line to an exchanging position where the work rolls and the rolling guides are exchanged with new ones. The continuous rolling mill further has a supporting frame supporting the roll stands and movable to the exchanging position thereby to bring the roll stands and rolling guides to the exchanging position, and an offsetting device adapted to move one of the adjacent roll stands relatively to the other of the adjacent roll stands and to the frame in the exchanging position such that the rolling lines of the adjacent roll stands may be offset from each other. This arrangement permits a reduction of the pitch or interval of the roll stands and affords a quick exchange of the rolls and rolling guides with new ones, contributing greatly to the reduction in installation space and cost while improving the efficiency of rate of operation of the rolling mill advantageously.

16 Claims, 6 Drawing Figures

CONTINUOUS ROLLING MILL

BACKGROUND OF THE INVENTION

1. Field of the Invention

The present invention relates to a continuous rolling mill equipped with horizontal roll stands and vertical roll stands arranged in series in an alternating manner. More particularly, the invention is concerned with a continuous rolling mill which is improved to facilitate the renewal of the rolls and the rolling guides incorporated in the roll stands.

2. Description of the Prior Art

A known continuous rolling mill such as, for example, a continuous finishing rolling mill for billet is equipped with a plurality of horizontal roll stands each having two horizontal rolls and a plurality of vertical roll stands each having two vertical rolls. The horizontal roll stands and the vertical roll stands are arranged alternatingly along the rolling path, with a rolling guide disposed between two adjacent roll stands. In this type of continuous rolling mill, it is desirable to decrease as much as possible the temperature drop of the billet during the rolling; this saves energy, and reduces the housing space and the cost for the fundamental construction.

These requirements, however, could not be fully met by the conventional continuous rolling mill due to the fact that, in the conventional continuous rolling mills, the respective roll stands arranged at a predetermined pitch or interval are movable independently in the direction which crosses the rolling line toward the roll and rolling guide exchanging positions. This problem will be explained in more detail hereinunder. Namely, in the continuous rolling mill, it is necessary to employ rolls of different sizes and rolling guides of different sizes in conformity with, for example, the size of the billet to be rolled. In order to achieve a high efficiency of the work for changing the rolls and rolling guides, it is desirable to extract all of the roll stands at one time to the exchanging position, i.e. to pull and move all roll stands in the direction perpendicular to the rolling line. In the conventional continuous rolling mill in which the roll stands are extractable independently, the space between two adjacent roll stands is utilized as a stand-by space for the roll stands to be substituted for the extracted roll stands. In exchanging the roll stands, the old roll stands are demounted by the movement in the extracting direction and then the new roll stands are moved from the stand-by positions to the mounting positions. Thus, in the conventional continuous rolling mill, it has been necessary to preserve, between each two adjacent roll stands, a distance of a length corresponding to the width of the roll stand. Namely, it has been difficult to reduce the pitch or interval of the roll stands to a size smaller than the width of the roll stand.

Japanese Patent Application, Laid-open No. 39014/1982 (Application No. 113489/1980) discloses a continuous rolling mill having a roll exchanging system improved to shorten the roll exchanging time, wherein the driving units for the horizontal and vertical roll stands are arranged in a staggered manner in the vertical and horizontal directions to reduce the pitch or interval of the roll stand arrangement, and wherein all roll stands are mounted on a single truck. For exchanging the rolls, the roll stands are moved at once by the truck to the roll exchanging position where new roll stands carrying new rolls and mounted on another truck are ready for exchanging, and the old roll stands are exchanged with the new roll stands at once together with housings, thus completing the roll exchange in a shorter period of time. This system, however, uneconomically requires a preparation of another set of housings for the horizontal and vertical roll stands.

SUMMARY OF THE INVENTION

Accordingly, an object of the invention is to provide a continuous rolling mill which is improved to reduce the pitch or interval of arrangement of the horizontal roll stands and vertical roll stands and to eliminate the necessity for separate preparation of another set of housings for the roll stands, while permitting a higher efficiency of the roll exchanging work and, hence, a higher rate of operation of the rolling mill.

To this end, according to the invention, there is provided a continuous rolling mill having horizontal roll stands and vertical roll stands which are disposed alternatingly with rolling guides between the work rolls of adjacent roll stands, the roll stands together with the rolling guides being movable in the direction crossing the rolling line to an exchanging position where the work rolls and the rolling guides are exchanged with new ones, wherein the improvement comprises: a supporting frame supporting the roll stands and movable to the exchanging position thereby to bring the roll stands and rolling guides to the exchanging position; and offsetting means adapted to move one of the adjacent roll stands relatively to the other of the adjacent roll stands and to the frame in the exchanging position such that the rolling lines of the adjacent roll stands may be offset from each other.

With this arrangement, it is possible to shorten the time required for the exchange of rolls and, hence, to increase the rate of operation of the continuous rolling mill.

The above and other objects, features and advantages of the invention will become clear from the following description of the preferred embodiment taken in conjunction with the accompanying drawings.

DESCRIPTION OF THE PREFERRED EMBODIMENT

An embodiment of the continuous rolling mill of the invention will be described hereinunder with reference to the accompanying drawings.

Figure 1:
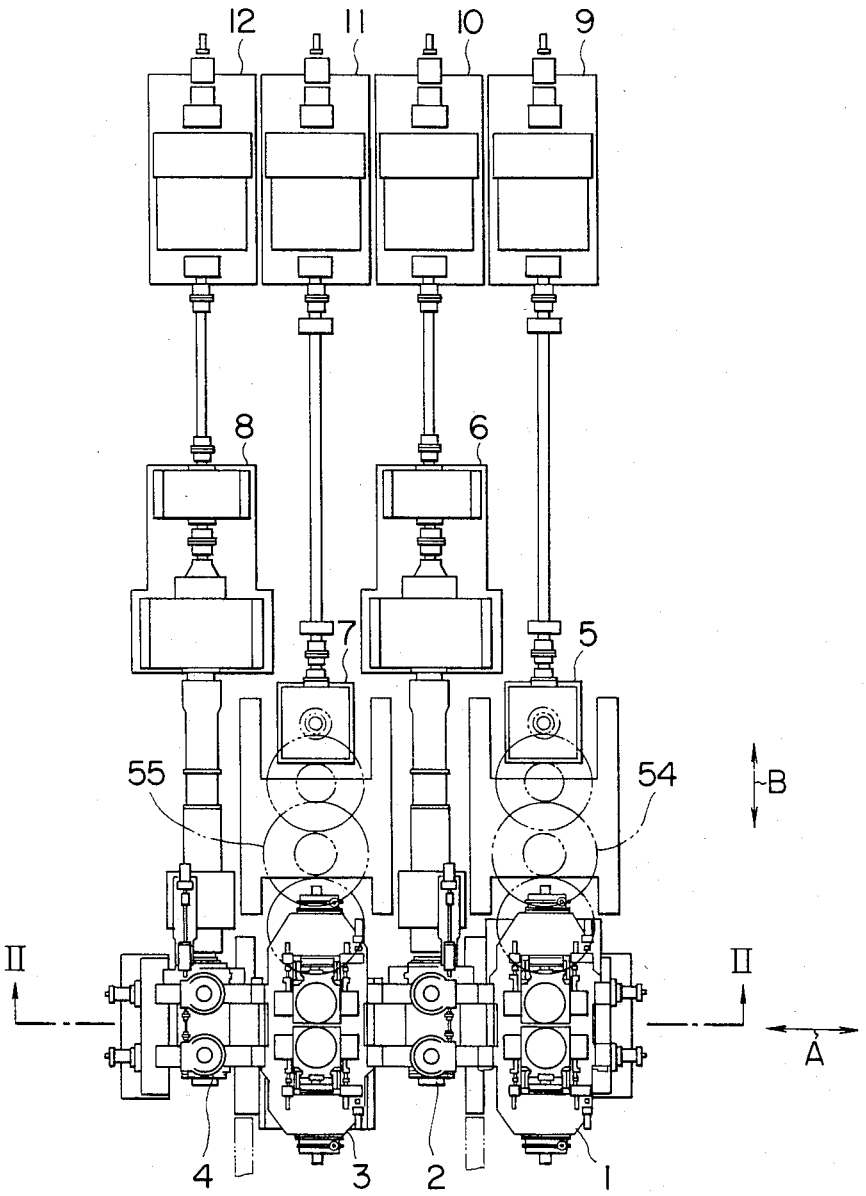
FIG. 1 is a plan view of a continuous rolling mill having horizontal and vertical roll stands arranged alternatingly, in the state in which the roll stands are mounted in the rolling position.
Figure 2:
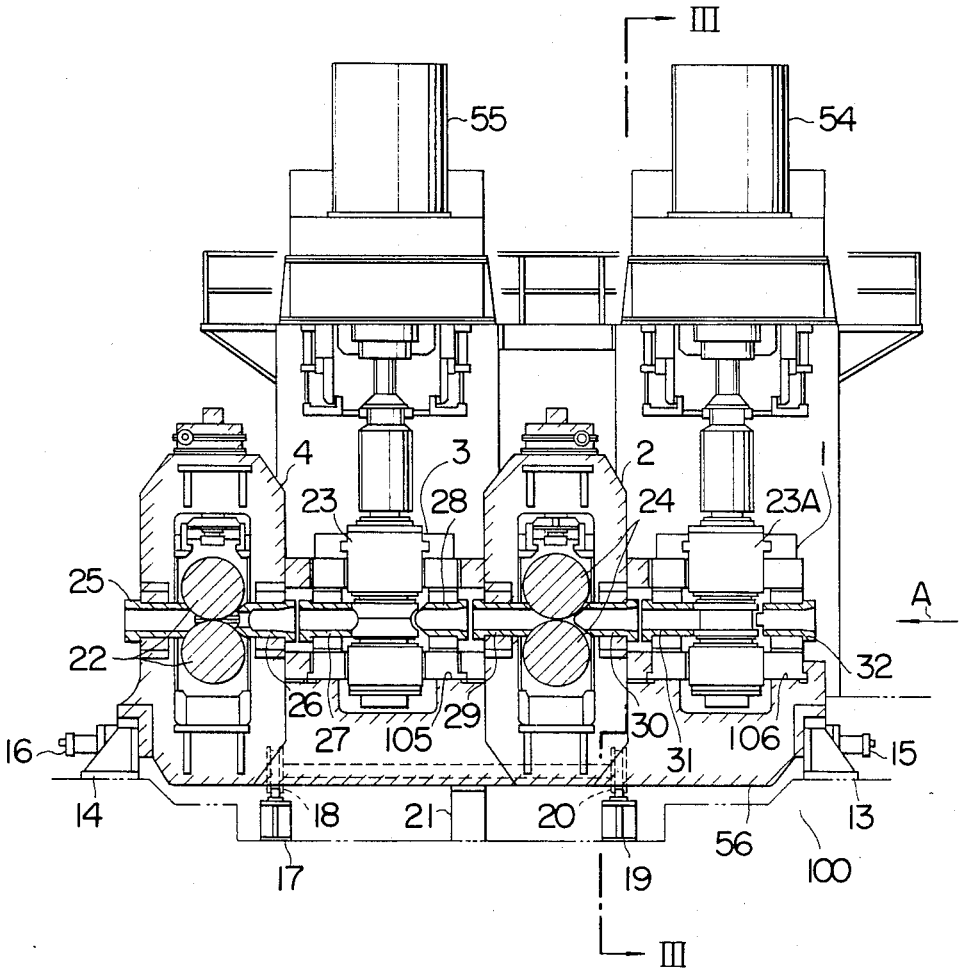
FIG. 2 is sectional view taken along the line II—II of FIG. 1.
Figure 3:
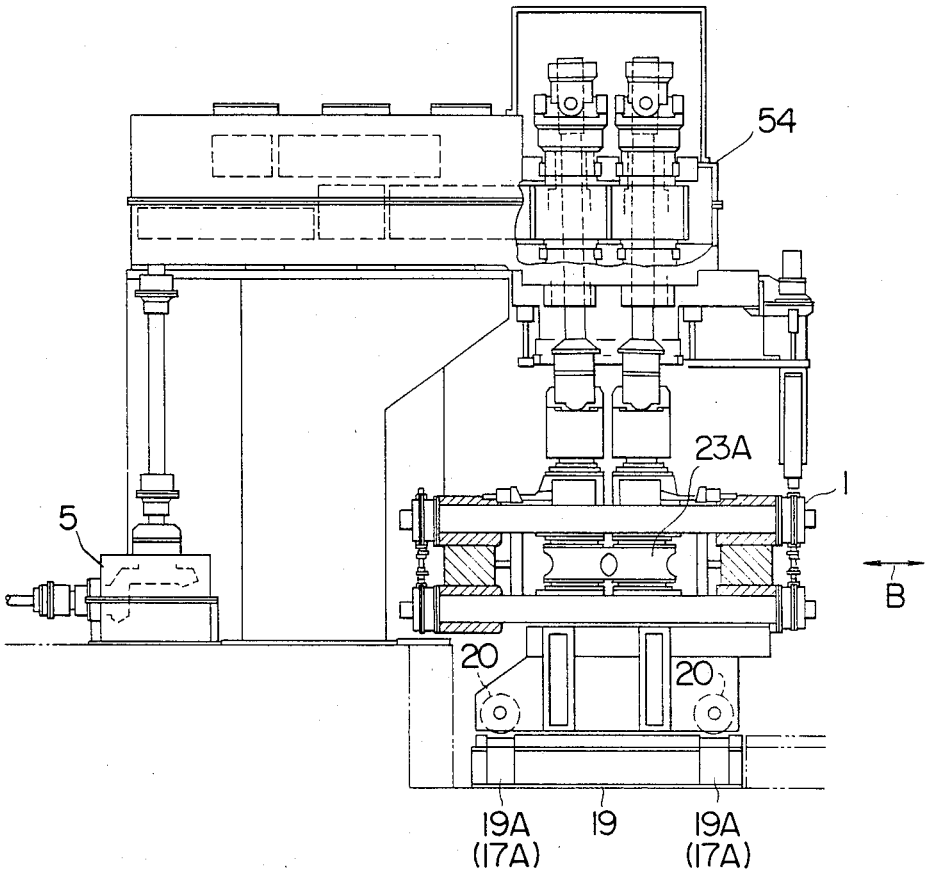
FIG. 3 is a sectional view taken along the line III—III of FIG. 2.

FIGS. 1 to 3 in combination show the continuous rolling mill of the invention in the state in which the roll stands are assembled in the rolling position. As will be seen from FIG. 2, the rolling mill has a pair of rails 17 and 19 laid on the floor or foundation 100 and extending in the direction B crossing the rolling line A. A frame 56 for supporting roll stands has wheels 18 and 20 adapted to run on and along the rails 17 and 19. The rails 17 and 19 are provided with sinkable portions 17A and 19A for locating the frame 56 at the rolling position, as shown in FIG. 3. Sole plates 13 and 14 adapted to act on both sides of the frame 56 to fix the latter at the rolling position are disposed on the floor 100. The sole plates 13 and 14 are associated with clamp cylinders 15 and 16 which press the sole plates 13 and 14 onto opposing sides of the frame 56. More specifically, when the frame is in the rolling position, the sinkable portions 17A and 19A of the rails 17 and 19 are made to sink so that the frame 56 is carried by the sole plates 13 and 14. Then, the clamp cylinders 15 and 16 are activated to fix the frame 56 at this position by pressing the frame 56 from both sides.

As hatched in FIG. 2, the frame 56 has a substantial length along the rolling line A. A horizontal roll stand 2 having a pair of horizontal work rolls 24 and a horizontal roll stand 4 having a pair of horizontal work rolls 22 are mounted on the frame 56. The continuous rolling mill further has a pair of vertical roll stands 1 and 3. The horizontal and vertical roll stands are arranged alternatingly as will be best seen from FIG. 1. The vertical roll stands 1 and 3 are adapted to be mounted on the frame 56 and are capable of running in the direction B as desired by means of wheels 103 and 104 that roll on the rails 17 and 19. These wheels 103 and 104 are positioned at the rear sides of the wheels 18 and 20 as viewed in FIG. 2, as will be understood from FIG. 2. Namely, the vertical roll stands 1 and 3 are adapted to be locked to the frame 56 but can be unlocked to move relatively to the frame 56 as desired. Reference numerals 23 and 23A denote, respectively, pairs of vertical work rolls mounted in the vertical roll stands 3 and 1, respectively.

The horizontal and vertical roll stands 2, 4, 1 and 3 are provided with respective rolling guides 25 to 32. More specifically, reference numerals 25 and 26 denote rolling guides at the outlet and inlet of the horizontal roll stand 4, 27 and 28 denote rolling guides at the outlet and inlet of the vertical roll stand 3, 29 and 30 denote rolling guides at the outlet and inlet of the horizontal roll stand 2, and 31 and 32 denote rolling guides at the outlet and inlet of the vertical roll stand 1. Namely, each roll stand is provided with a pair of rolling guides, one at the inlet side and the other at the outlet side thereof.

The work rolls 23A and 23 of the vertical roll stands 1 and 3 are adapted to be driven by motors 9 and 11, through upper driving units 54 and 55 and speed reducers 5 and 7, respectively. Similarly, the work rolls 24 and 22 of the horizontal roll stands 2 and 4 are driven by motors 10 and 12, through speed reducers 6 and 8, respectively. A reference numeral 21 designates a supporting device for supporting the elongated frame 56 substantially at the lower central portion of the latter so as to prevent any deflection of the frame 56.

Figure 4:
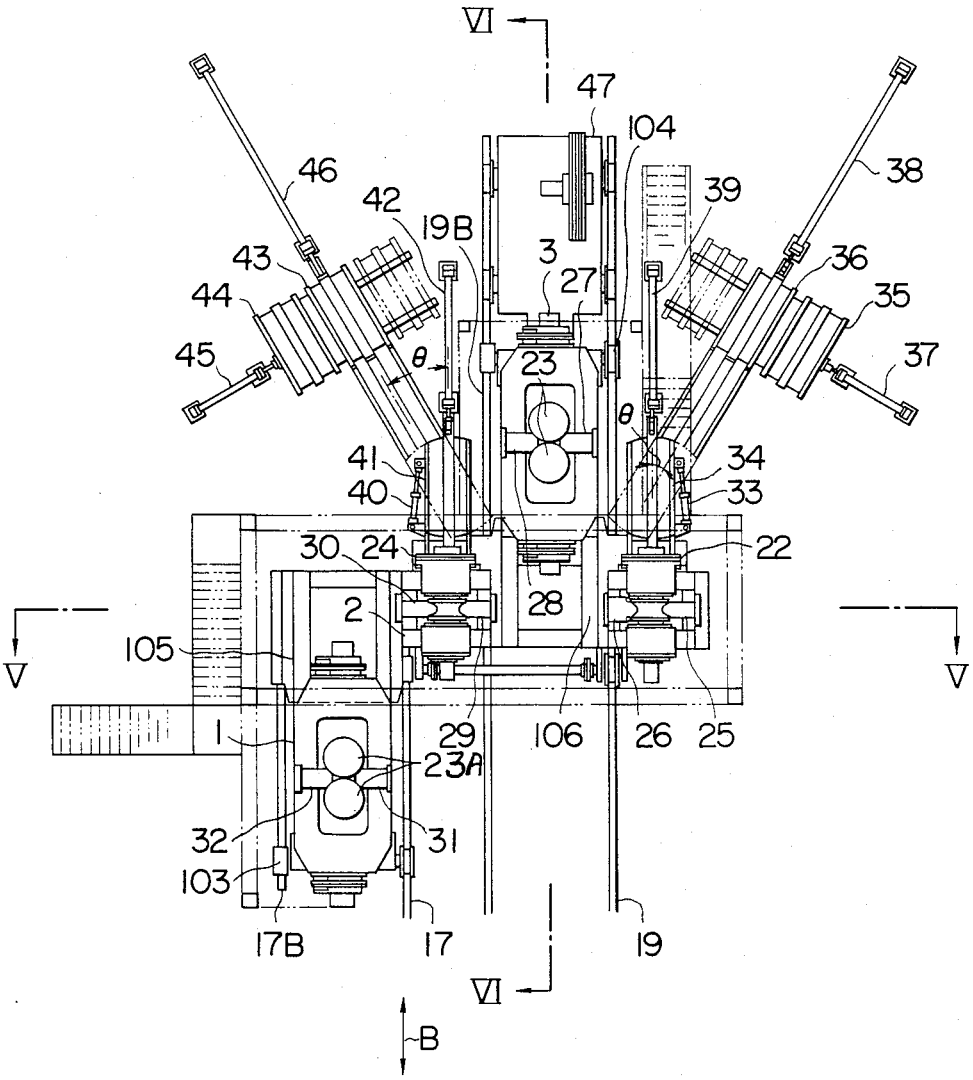
FIG. 4 is a plan view of the continuous rolling mill shown rotated 180° from the orientation in FIG. 1, in the state in which the roll stands are disosed at roll exchanging positions.
Figure 5:
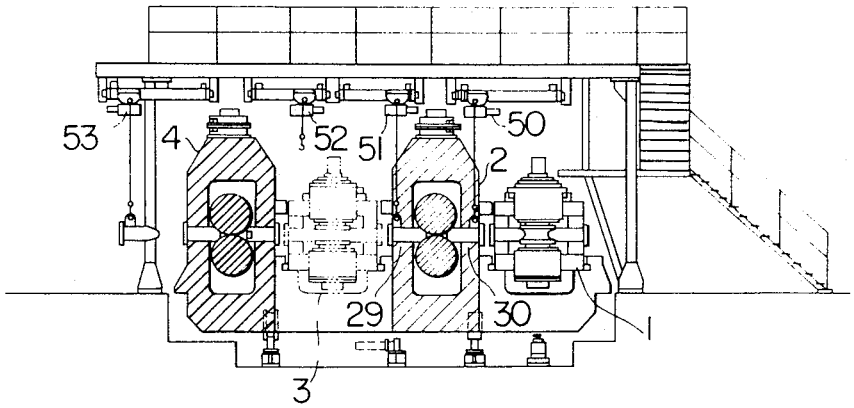
FIG. 5 is a sectional view taken along the line V—V of FIG. 4.
Figure 6:
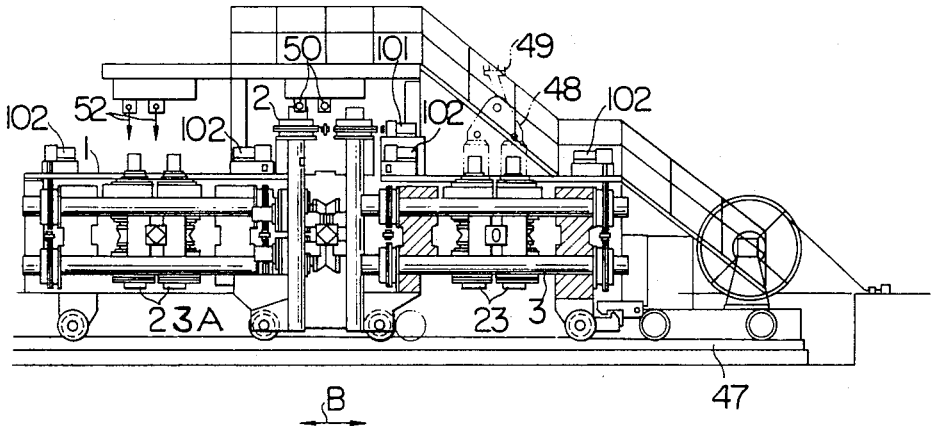
FIG. 6 is a sectional view taken along the line VI—VI of FIG. 4.

FIGS. 4 to 6 show roll stands of the rolling mill in the roll exchanging positions. Namely, the frame 56 has been extracted along the rails 17 and 19 in the direction B crossing the rolling line A, and the vertical roll stands 1 and 3 have been extracted further from the frame 56 such that the lines of adjacent roll stands are offset from each other. The vertical roll stands 1 and 3 are provided at their ends with wheels 103 and 104 for permitting the extraction of these vertical roll stands 1 and 3. These wheels 103 and 104 are adapted to run on the rails 17 and 19 and auxiliary rails 17B and 19B extending in parallel with the rails 17 and 19. The vertical roll stands 1 and 3 are adapted to be placed above the mounting surfaces 106 and 105 on the frame 56 with a slight gap or lift therebetween. Although not shown, means are provided for fixing the vertical roll stands 1 and 3.

As shown in FIGS. 4 to 6, for exchanging the rolls and rolling guides, the vertical roll stands 1 and 3 are extracted by a roll stand extracting device 47 such that the rolling lines of adjacent roll stands are offset or staggered. The exchanging of rolls and rolling guides is conducted in accordance with a change in the shape or size of the material to be rolled. An explanation will be made hereinunder as to how the exchange of the rolls and rolling guides is actually conducted.

The inlet guide 30 associated with the horizontal roll stand 2 is removed by a hoist 50 which is disposed above the roll exchanging position as shown in FIG. 5. At the same time, the outlet guide 29 of the horizontal roll stand 2 is removed by another hoist 51. Then, the horizontal rolls 24 of the roll stand 2 are extracted onto a turn table 41 which is rotatably situated at the extract position, by means of a roll extracting cylinder 42 which is disposed in parallel with the rails 17 and 19 as shown in FIG. 4. A turning cylinder 40 is adapted to turn the turn table 41 to a direction offset by a predetermined angle $\theta$ from the direction B. Then, the horizontal rolls 24 are extracted onto a side shift truck 43 by a roll extracting cylinder 46 which has an axis extending in the offset direction of the turn table. The side shift truck 43 is provided with mounting surfaces 44 at both lateral sides thereof as viewed in the extracting direction, and new horizontal rolls are mounted on one of the mounting surfaces. Namely, the old horizontal rolls 24 which have been extracted onto the side shift truck 43 are transferred to vacant one of the mounting surfaces 44 by a side shift cylinder 45, which also aligns the new rolls with turn table 41. Then, the horizontal rolls to be newly mounted are pushed onto the turn table 41 by the reverse or pushing operation of the roll extraction cylinder 46. Subsequently, the turn table 41 is turned by an angle $\theta$ and the new horizontal rolls are forced into the horizontal roll stand 2 thus completing the exchange of the rolls on the horizontal roll stand 2. After the exchange of the horizontal rolls, a new inlet side rolling guide 30 and a new outlet side rolling guide 29 are set up by the hoist 50 and by the hoist 51, respectively. The exchange of rolls and rolling guides with the horizontal roll stand 2 is now over. Thereafter, the roll clearance for setting the rolling line is adjusted by means of a clearance setting drive unit 101 which is incorporated in the horizontal roll stand 2 as shown in FIG. 6, thereby to complete the adjusting work with the horizontal roll stand 2. The exchange of rolls and guides, as well as the clearance adjustment, on the other horizontal roll stand 4 is conducted in the same manner as that for the horizontal roll stand 2, so that no further explanation is made here as to the exchange and adjustment on the horizontal roll stand 4, which uses hoist 53, cylinders 37, 38 and 39, side shift cyliner 37, truck 36, mounting surfaces 35, turn table 34 and cyliner 33.

On the other hand, the exchange of the rolls and guides on the vertical roll stand 1 is conducted in the following procedure. This vertical roll stand 1 has been extracted in the rolling side (lower side as viewed in FIG. 4) from the frame 56 which has been extracted to and held at the exchanging position by the extracting device 47. Then, the outlet side rolling guide 31 and the inlet side rolling guide 32 are removed by a hoist 52 and another hoist (not shown but disposed at one side of the hoist 52), respectively, as shown in FIGS. 5 and 6. Subsequently, the rolls 23A are demounted by means of a crane hook not shown, but the (same as a hook 49 for the other vertical roll stand 3 shown at right side in FIG. 6) of an overhead travelling crane and a vertical roll hoisting jig (not shown, but the same as jig 48 for the other vertical roll stand 3), and new vertical rolls are set up by means of the crane hook and the jig. Thereafter, new roll guides 31 and 32 for the outlet and inlet sides of the vertical roll stand 1 are mounted by respective hoists to complete the exchanging work. As in the case of the horizontal roll stand, the roll clearance is adjusted by a clearance setting drive unit 102, subsequently to the exchange of the rolls and guides. The roll and guide exchange work and adjusting work are now finished with the vertical roll stand 1. The procedure for exchanging rolls and guides on the other vertical roll stand 3 is not explained in detail because it is materially identical to that for the vertical roll stand 1.

After the completion of exchange of rolls and rolling guides with all roll stands, the vertical roll stands 1 and 3 are mounted on and fixed to the frame 56 such that the rolling lines of the vertical roll stands 1 and 3 coincide with the rolling line of the horizontal roll stands 2, 4, while these roll stands 2, 4 and 1, 3 remain in the exchange position. The roll stands 1, 2, 3 and 4 after attaining the alignment of the rolling line are then moved to the rolling position by the movement of the frame 56 as shown in FIGS. 1 thru 3. Then, the sinkable portions 17A and 19A of the rails 17 and 19 are made to sink so that both side portions of the frame 56 rest on the sole plates 13 and 14 which are then actuated by the clamp cylinders 15 and 16 thereby to fix the frame 56.

According to the described arrangement and exchanging method, the exchange of rolls and guides and the line adjustment are finished while the roll stands remain in the exchanging position, so that the rolling can be started right away after the movement of the roll stands to the rolling position. It is, therefore, possible to attain a higher, easier and more accurate exchange of rolls and roll guides as compared with the conventional arrangement in which all horizontal roll stands and all vertical roll stands are extracted independently and the rolling line adjustment is made only after the setting of new rolls and roll guides on the rolling position. Thus, the present invention offers an increase of the rate of operation of the continuous rolling mill, and permits an automation employing control machines, contributing greatly to the saving of labor and improvement in economy.

In the described embodiment, the horizontal roll stands and the vertical roll stands as a whole are extracted to the exchanging position and then the roll stands in the exchanging position are rearranged such that the rolling lines of these roll stands are offset. The exchange of the rolls and rolling guides is then conducted by making an efficient use of the spaces produced by the offset rearrangement of the roll stands. The continuous rolling mill of the invention, therefore, does not require such a large distance or interval between adjacent roll stands as corresponding to the width of each roll stand, unlike the conventional continuous rolling mill in which the roll stands are independently extracted to the exchanging position and the spaces between adjacent roll stands in the exchanging positions are utilized as the stand-by spaces where new rolls and rolling guides are placed preparing for the exchange. Namely, according to the invention, it is possible to remarkably reduce the distance between the horizontal roll stand and adjacent vertical roll stands. This presents various advantageous effects such as suppression of the temperature drop of the rolled material such as billet which in turn affords a higher thermal efficiency of the rolling work, decrease in the environmental space, reduction in size of the rolling line as a whole which in turn permits reduction in size of house and foundation, and so forth.

Particularly, in the described embodiment incorporating the turn table 41, the movement of the rolls for roll exchanging work is made in a direction which is inclined to the direction of movement of the supporting frame to permit an efficient use of the dead space. Thus, the described embodiment affords a higher rate of utilization of the space.

In addition, in the described embodiment, the mounting and demounting of the rolls and rolling guides is conducted with specific hoists such as the hoist 50. This offers, in combination with the efficient use of the space, a higher practicality of the continuous rolling mill of the invention.

Furthermore, in the described embodiment, it is possible to finish the adjustment of the rolling line after the exchange of rolls and rolling guides while the new rolls are still in the exchanging position, thanks to the provision of driving units for setting roll clearance, e.g. the driving unit 101. Accordingly, the efficiency of the roll exchanging work is improved considerably.

As has been described, according to the invention, the work for exchanging the rolls and the rolling guides with new ones can be conducted through making efficient use of the spaces produced by offsetting of the roll stands after bringing all roll stands and the rolling guides as a unit to the exchanging position. In consequence, the invention offers various advantages such as reduction of pitch or interval of the roll stands, quick exchange of rolls and rolling guides and higher rate of operation of the continuous rolling mill as a whole.

Although the invention has been described through a specific embodiment employing two vertical roll stands and two horizontal roll stands arranged in an alternating manner, this is not exclusive and the number of the roll stands may be increased or decreased as required. Other changes and modification are possible within the scope of the invention which is limited solely by the appended claims.

What is claimed is:

1. A continuous rolling mill, comprising:

horizontal roll stands and vertical roll stands disposed alternatingly along a rolling line;

rolling guides aligned between the work rolls of adjacent roll stands;

a frame supporting said roll stands;

rails transverse to the rolling line supporting said frame operatively to be movable in the direction crossing the rolling line to a first exchanging position together with said roll stands and said rolling guides;

at least some of said roll stands being mounted for movement relative to said frame in respective stand extracting directions;

rails respectively adjacent said some roll stands in alignment with said stand extracting directions when said frame is in said first exchanging position;

offsetting means for moving said some of the roll stands relative to said frame along their rails, away from the other roll stands, and from said first exchanging position to a second exchanging position where the rolling lines of the horizontal roll stands and the vertical roll stands are offset from each other so that the offset provides sufficient room that rolls may be extracted and exchanged from all the roll stands.

2. A continuous rolling mill according to claim 1, wherein the roll stands moved by said offsetting means are the vertical roll stands.

3. A continuous rolling mill according to claim 1, further comprising a turn table and a side shift truck disposed at said exchanging position and adapted to guide and move said horizontal roll stands in a direction crossing the direction of movement of said supporting frame at a predetermined angle, from said exchanging position to a horizontal roll exchanging station.

4. A continuous rolling mill according to claim 1, further comprising hoists for exchanging the rolling guides at the inlet and outlet sides of said roll stands, said hoists being disposed above the corresponding rolling guides of said roll stands arranged in the offset manner in said exchanging position.

5. A continuous rolling mill according to claim 1, further comprising a driving unit for setting the roll clearance of each roll stand, said driving unit being attached to the corresponding roll stand or mounted on said frame.

6. A continuous rolling mill according to claim 5, further wherein the roll stands moved by said offsetting means are the vertical roll stands.

7. A continuous rolling mill according to claim 6, further comprising a turn table and a side shift truck disposed at said exchanging position and adapted to guide and move said horizontal roll stands in a direction crossing the direction of movement of said supporting frame at a predetermined angle, from said exchanging position to a horizontal roll exchanging station.

8. A continuous rolling mill according to claim 7, further comprising hoists for exchanging the rolling guides at the inlet and outlet sides of said roll stands, said hoists being disposed above the corresponding rolling guides of said roll stands arranged in the offset manner in said exchanging position.

9. A continuous rolling mill according to claim 6, further comprising hoists for exchanging the rolling guides at the inlet and outlet sides of said roll stands, said hoists being disposed above the corresponding rolling guides of said roll stands arranged in the offset manner in said exchanging position.

10. A continuous rolling mill according to claim 5, further comprising a turn table and a side shift truck disposed at said exchanging position and adapted to guide and move said horizontal roll stands in a direction crossing the direction of movement of said supporting frame at a predetermined angle, from said exchanging position to a horizontal roll exchanging station.

11. A continuous rolling mill according to claim 10, further comprising hoists for exchanging the rolling guides at the inlet and outlet sides of said roll stands, said hoists being disposed above the corresponding rolling guides of said roll stands arranged in the offset manner in said exchanging position.

12. A continuous rolling mill according to claim 5, further comprising hoists for exchanging the rolling guides at the inlet and outlet sides of said roll stands, said hoists being disposed above the corresponding rolling guides of said roll stands arranged in the offset manner in said exchanging position.

13. A continuous rolling mill according to claim 2, further comprising a turn table and a side shift truck disposed at said exchanging position and adapted to guide and move said horizontal roll stands in a direction crossing the direction of movement of said supporting frame at a predetermined angle, from said exchanging position to a horizontal roll exchanging station.

14. A continuous rolling mill according to claim 13, further comprising hoists for exchanging the rolling guides at the inlet and outlet sides of said roll stands, said hoists being disposed above the corresponding rolling guides of said roll stands arranged in the offset manner in said exchanging position.

15. A continuous rolling mill according to claim 3, further comprising hoists for exchanging the rolling guides at the inlet and outlet sides of said roll stands, said hoists being disposed above the corresponding rolling guides of said roll stands arranged in the offset manner in said exchanging position.

16. A continuous rolling mill according to claim 4, further comprising a driving unit for setting the roll clearance of each roll stand, said driving unit being attached to the corresponding roll stand or mounted on said frame.

* * * * *